United States Patent [19]

Chap

[11] Patent Number: 4,776,470

[45] Date of Patent: Oct. 11, 1988

[54] SHELF UNIT FOR STORING BOTTLES, CANS AND THE LIKE

[75] Inventor: John P. Chap, Lemont, Ill.

[73] Assignee: Selfix, Inc., Chicago, Ill.

[21] Appl. No.: 139,988

[22] Filed: Dec. 31, 1987

[51] Int. Cl.[4] ..... A47F 5/01; A47F 7/28

[52] U.S. Cl. ..... 211/59.2; 211/74; 211/181

[58] Field of Search ..... 211/59.2, 181, 134, 211/74; 312/45, 74

[56] References Cited

U.S. PATENT DOCUMENTS

| | | | |
|---|---|---|---|
| 2,125,000 | 7/1938 | Considine | 211/59.2 |
| 2,546,587 | 3/1951 | Eisenberg | 211/181 X |
| 3,203,553 | 8/1965 | Pendergrast et al. | 211/59.2 |
| 3,805,964 | 4/1974 | Titus | 211/59.2 |
| 4,583,646 | 4/1986 | Bowman | 211/181 X |

*Primary Examiner*—Robert W. Gibson, Jr.

*Attorney, Agent, or Firm*—Dressler, Goldsmith, Shore, Sutker & Milnamow

[57] ABSTRACT

A free standing article-supporting structure arranged such that articles may be supported by and are readily removable from such structure. The structure comprises an open-sided frame having a pair of laterally spaced arms including a transversely extending base portion for maintaining such arms in a normally upstruck pose. The arms are joined by one or more reinforced connecting members. The structure further includes one or more laterally elongated slanting shelves affixed to the reinforcing connecting member and extending transversely from the frame. Each shelf is formed from a relatively rigid wire or rod and typically is coated with a material such as vinyl or plastic. A retaining device is provided at opposite ends of the shelf for preventing articles from unwantingly rolling from the shelf. Moreover, an article-retaining lip is provided at the transverse limit of the shelf unit for influencing transverse movement of the articles on the shelf.

11 Claims, 1 Drawing Sheet

SHELF UNIT FOR STORING BOTTLES, CANS AND THE LIKE

FIELD OF THE INVENTION

The present invention relates to shelf structures and, more particularly, to shelf structures formed from plastic-coated wire and including one or more cantilevered shelves.

BSCKGROUND OF THE INVENTION

Plastic-coated metal wire devices have become very popular consumer items. These types of goods are available in a wide variety of configurations including shelves, racks, baskets and like arrangements which facilitate convenient storage of articles where desired. Because various colors and types of plastic coating can be applied to these products, they can be used in a myriad of locations throughout the home.

Because of their light weight, baskets or racks formed of coated wire material have proven particularly useful. Many of such baskets and racks are formed or configured so as to facilitate easy mounting thereof by way of fasteners, etc. Shelving units which are free standing or self-supporting are particularly useful throughout the household because of their added versatility.

Shelving units come in a variety of shapes and sizes. U.S. Pat. No. 4,444,320 to J. P. Chap discloses a stackable shelf unit formed of wire-coated material. U.S. Pat. No. 4,666,201 also issued to J. P. Chap discloses a shelf unit having a back-to-back cantilevered shelf design. Such shelving lends itself to a multitude of purposes. As an example, a shelving unit may be used for supporting lightweight containers or boxes. On the other hand, shelving units may be used to conveniently store articles such as bottles and cans within confined or limited space constraints. Whatever its use, articles arranged on the shelves must be readily convenient and accessible to the user.

Unlike other storage devices which provide shelving for just a few items, a shelving unit for storing bottles and cans should arrange the cans/bottles to maximize space yet allowing the bottles and cans to be arranged thereon in an accessible and removable manner. That is, the shelf unit should be designed to allow articles, including axially elongated forms of articles such as bottles, to be readily stored on the shelves as well as being readily retrievable therefrom. Because the shelf unit is made of wire, the shelving unit should have strength to support concentrated weights and loads. That is, the shelf unit, while maximizing storage, must be strong enough to hold several weighted articles. Moreover, such devices should be designed such that when stored, shipped, and displayed, they consume the least amount of space.

Heretofore, no known shelving unit having a cantilevered design has been configured in a manner which provides a solution to all of the above-mentioned problems involving nestability, compactness, and strength. Moreover, the known free standing shelving units are not suitable for both storing bottles and cans yet allowing ready access thereto.

SUMMARY OF THE INVENTION

In view of the above, and in accordance with the present invention, there is provided a unique self-standing article-supporting structure. A structure embodying the principles of the present invention includes an open-sided frame structure having one or more cantilevered and slanting or sloping shelves transversely extending from the frame structure. The entire unit is a coated wire structure.

Because of its open-sided construction, axially elongated articles such as bottles, can be readily added to or removed therefrom. Moreover, the shelf also provides a convenient storage means for cans. Because the shelves are slanted, articles supported thereon may be arranged one behind another. As such, when one article is removed, another is automatically presented to a position where it too can readily be removed from the unit. The open-sided structure of the present invention also has advantages for the manufacturer. Such a design adds a unique nestability feature. That is, a plurality of such units may be nested together for shipping and storing purposes.

The frame structure of this invention includes a pair of laterally spaced arms having a transversely extending base portion for maintaining the arms in a normally upstruck pose. The arms are joined together by one or more reinforced connecting members. The shelving unit further includes one or more laterally elongated slanting shelves. Each shelf is affixed to a reinforced connecting member and extends transversely from the frame in a cantilevered fashion to establish an open-sided structure. Each shelf is arranged such that the articles arranged thereon may be supported by and are removable from the shelf. Because of its open-sided design, axially elongated bottles may be supported thereby. Each slanting shelf includes article-retaining means at opposite lateral ends thereof for preventing the articles from inadvertently or unwantingly rolling from the shelf. Moreover, each shelf includes an article-retaining lip which defines the transverse limit of the shelf. Such lip acts to transversely constrain articles, such as cans, on the shelf while allowing bottle portions to extend thereover. In the preferred embodiment, the lateral length of the shelf including the article retaining means at the en· of each shelf is less than the lateral spacing between the upstruck arms. By this design, nesting of one supporting structure within the other is easily achieved.

Numerous other advantages and features of the present invention will become readily apparent from the following detailed description of the invention and embodiment thereof, from the claims, and from the accompanying drawings.

DETAILED DESCRIPTION OF THE PREFERRED EMBODIMENT

Figure 1:
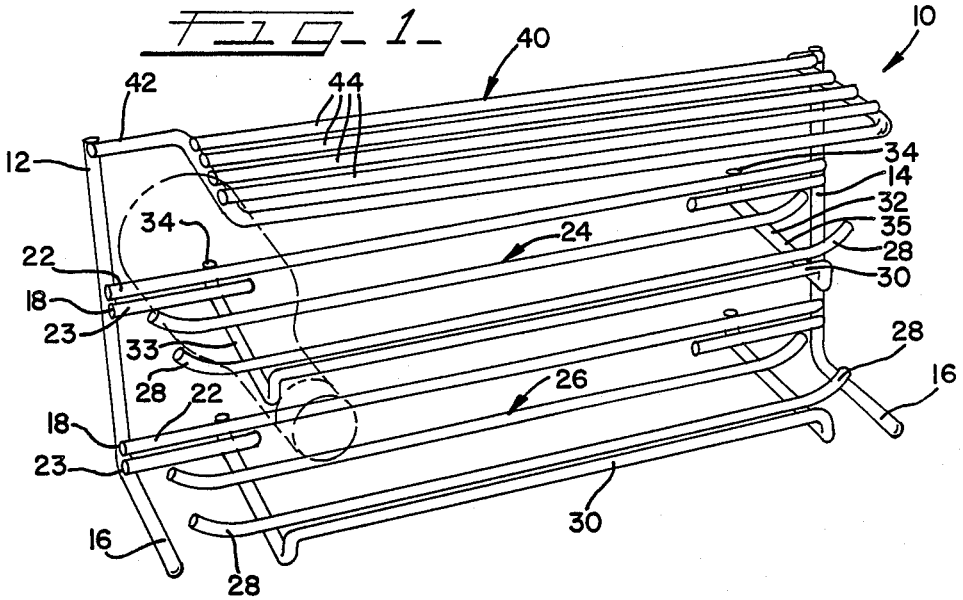
FIG. 1 is a perspective view of a shelf unit embodying the principles of the present invention.

While this invention is susceptible of embodiment in many different forms, there is shown in the drawing and will be described herein in detail, a specific embodiment with the understanding that the present disclosure is to be considered as an exemplification of the principles of the invention and is not intended to limit the invention to the specific embodiment illustrated.

Turning now to the drawings, wherein like reference numerals indicate like parts throughout the several views, there is shown a presently preferred embodiment of a free or self-standing shelf structure 10. The shelf unit 10 itself is formed from relatively rigid wires or rods and typically is coated with a material such as vinyl or plastic. The shelf unit 10 includes an open-sided frame comprised of a pair of laterally spaced-apart arms 12, 14. Each arm includes a transversely extending base support means 16 for maintaining the arms 12, 14 in an upwardly extending pose or fashion. At vertically spaced locations along the arms 12, 14, one or more reinforced connecting members 18 are provided to add rigidity to the frame structure. In the illustrated embodiment, each reinforced connecting member is formed from at least two vertically spaced elements or rods 22, 23.

The shelf unit 10 further includes laterally elongated shelves 24 and 26. The shelves are vertically spaced and arranged such that articles may be supported by and readily removed therefrom. As may be best illustrated in FIG. 2, each shelf is horizontally slanted such that one end of the shelf is lower than the other. Article-retaining means 28 are provided at opposite lateral ends of each shelf for controlling displacement of articles placed on the shelf within predetermined lateral limits. That is, the article-retaining means 28 are provided to prevent articles arranged on the shelf from unwantingly rolling from the shelf.

An article-retaining lip 30 may also be provided on each shelf for defining the outer transverse limit of that shelf. As will be understood, such lip 30 limits transverse displacement of cans arranged on the shelf while allowing axially elongated articles such as bottles to extend over and beyond the shelf.

For purposes of the present disclosure, reference will be made to shelf 24 in describing the preferred construction thereof, with the understanding that the other shelf may be of similar construction.

Figure 2:
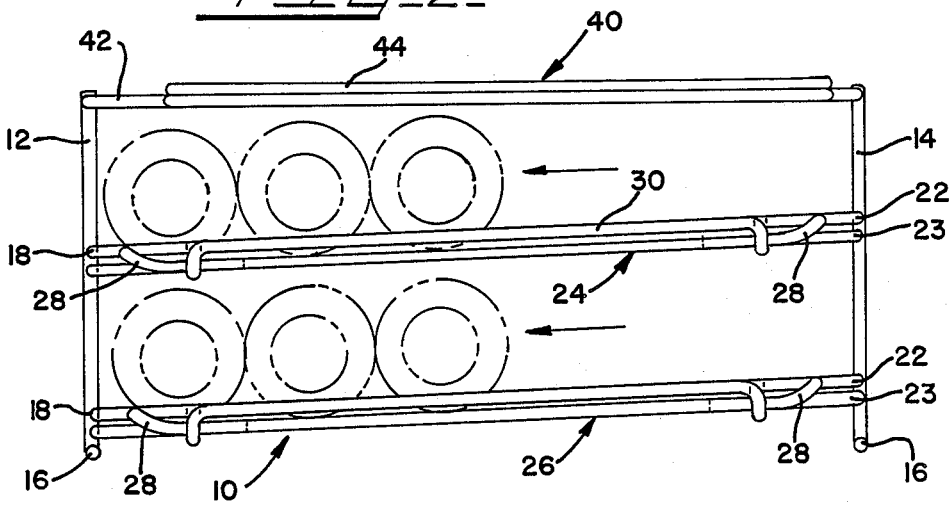
FIG. 2 is a front elevational view of the shelf unit of FIG. 1.

Returning to FIG. 1, in the illustrated embodiment, each shelf of the unit 10 is comprised of a U-shaped support 32 with oppositely disposed legs 33, 35 transversely extending away from the plane defined by the vertical legs 12 and 14 of the frame. The free end 34 of each leg 33, 35 is bent upwardly and is affixed to the associated reinforced connecting member 18. It should be noted that the upwardly bent ends engage both elements 22 and 23 of the reinforced connecting member. By such design, shelf supporting capacity is increased. The bight portion of the support member 32 defines the article-retaining lip 30. That is, and as best illustrated in FIG. 2, the bight portion of the support member 32 is bent upward to extend above the horizontal plane defined by the shelf to define the article-retaining lip 30. Each shelf further includes a plurality of laterally extending spaced-apart wires 36 which are secured to transversely extending legs 33, 35 of the support 32. In the illustrated embodiment, arcuately upturned ends of each wire 36 define the article-retaining means 28 for the shelf unit. As illustrated, the arcuately upturned ends of each wire 36 laterally extend in a cantilevered fashion from the legs 33, 35 of the support 32. Moreover, it should be noted that each shelf in the unit including the article retaining means extends a lesser lateral distance than the lateral spacing between the arms 12, 14 of the unit. As such, each shelf unit may be compactly arranged within another during shipping and for display purposes.

Returning to FIG. 1, another shelf means 40 may be disposed above the top or upper slanting shelf of the shelf unit. The shelf means 40 includes a support arm 42 whose free ends are connected proximate to the upper extremities of each arm 12, 14. A plurality of laterally extending, transversely spaced wires 44 are each connected to the support 42. By such construction, support shelf 40 protects those articles supported on the shelves disposed therebeneath it. It should again be noted that shelf means 40 extends a lesser lateral distance than the lateral spacing between arms 12, 14 of the unit.

As a result of the construction of the shelf unit in accordance with the present invention, there is provided an article-supporting structure of a cantilevered design which allows or permits a plethora of articles to be stored while allowing quick and ready access thereto. The open-sided design allows articles such as bottles to extend over the sides and adds to the compactness of the shelving unit. The reinforced construction adds capacity to the shelf unit notwithstanding the cantilevered design. Moreover, the open-sided construction taught by the present invention allows such units to be shipped, stored, and displayed within limited space availabilities.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the spirit and scope of the claims.

Thus, having adequately described the invention, what I claim is:

1. A self-standing article supporting structure comprising:

an open-sided frame comprising a pair of laterally spaced arms including means for maintaining said arms in a normally upstruck pose, said arms being joined by at least one reinforced connecting member; and at least one laterally elongated slanting shelf affixed to said reinforced connecting member and extending transverse from said frame, said shelf being arranged such that articles may be supported by and are removable from said shelf, said slanting shelf having article-retaining means at opposite ends thereof for controlling article displacement within predetermined lateral limits and an article-retaining lip provided at the transverse limit of said shelf for influencing transverse article displacement.

2. The article-supporting structure of claim 1 wherein said shelf comprises:

a U-shaped support transversely extending from said frame, the free ends of said support being connected to said reinforced member and the bight portion of which defines said article-retaining lip with a plurality of spaced-apart members being carried by transversely extending arms of said support.

3. The article-supporting structure of claim 1 wherein said reinforced connecting member being formed from two vertically spaced elements both of which provide support for said shelf.

4. The article-supporting structure of claim 1 wherein said article-retaining means comprise arcuately upturned ends of said shelf.

5. The article-supporting structure of claim 1 wherein said shelf spans a lateral distance which is less than the lateral spacing between said arms.

6. The article-supporting structure of claim 2 wherein said support and said plurality of spaced-apart members comprising coated wire.

7. A self-standing article-supporting structure comprising:

an open-sided frame comprising a pair of laterally spaced arms, each arm having a transversely extending base portion for maintaining said arms in an upstanding fashion, said arms being joined by at least two vertically spaced reinforced connecting members;

at least two laterally elongated, slanting cantilevered shelves one arranged above the other, one shelf being affixed to each connecting member and extending transversely away from said frame such that articles can be supported by and are removable from said shelf, each slanting shelf having article-retaining means at opposite ends thereof for restraining lateral article displacement on said shelf within predetermined limits and an article-retaining lip provided at the transverse limit of said shelf for influencing transverse article displacement; and means disposed above the uppermost shelf and connected to said frame for protecting articles disposed on said uppermost shelf.

8. The article-supporting structure of claim 7 wherein each slanting shelf comprises:

a U-shaped support transversely extending from said frame, the free ends of said support being connected to a reinforced connecting member and the bight portion of which defines said article-retaining lip with a plurality of spaced-apart members being carried by transversely extending arms of said support.

9. The article-supporting structure of claim 7 wherein each of said reinforced connecting members being formed from two vertically spaced elements both of which provide support for a slanting shelf.

10. The article-supporting structure of claim 7 wherein said article-retaining means comprise arcuately upturned ends of said shelf.

11. The article-supporting structure of claim 7 wherein each slanting shelf laterally spans a lateral distance which is less than the lateral spacing between said arms.

* * * * *